United States Patent [19]

Kinoshita et al.

[11] 4,115,284

[45] Sep. 19, 1978

[54] BRAKE GREASE COMPOSITIONS

[75] Inventors: Hirotugu Kinoshita, Yokohama; Makoto Sekiya; Nobuo Makino, both of Kawasaki, all of Japan

[73] Assignee: Nippon Oil Co., Ltd., Tokyo, Japan

[21] Appl. No.: 807,691

[22] Filed: Jun. 17, 1977

[30] Foreign Application Priority Data

Jan. 21, 1976 [JP] Japan ..... 51-72269

[51] Int. Cl.[2] ..... C10M 1/10; C10M 3/02 C10M/5/02; C10M/7/02

[52] U.S. Cl. ..... 252/29; 252/25; 252/51.5 A; 252/52 A

[58] Field of Search ..... 252/25, 51.5 A, 29, 252/52 A

[56] References Cited

U.S. PATENT DOCUMENTS 2,710,841 6/1955 Swakon et al. ..... 252/51.5 A

*Primary Examiner*—Irving Vaughn

*Attorney, Agent, or Firm*—Frank J. Jordan

[57] ABSTRACT

Grease compositions comprising (A) a specific polyoxypropylene glycol monoether as the lubricating base oil and (B) a specific gelling agent as the thickening agent, consisting of at least one diurea compound represented by the formula wherein $R_1$ is a divalent aromatic hydrocarbon radical, and $R_2$ and $R_3$ a cyclohexyl group, a cyclohexyl derivative group having 7-12 carbon atoms, or an alkyl group having 8-20 carbon atoms.

7 Claims, 1 Drawing Figure

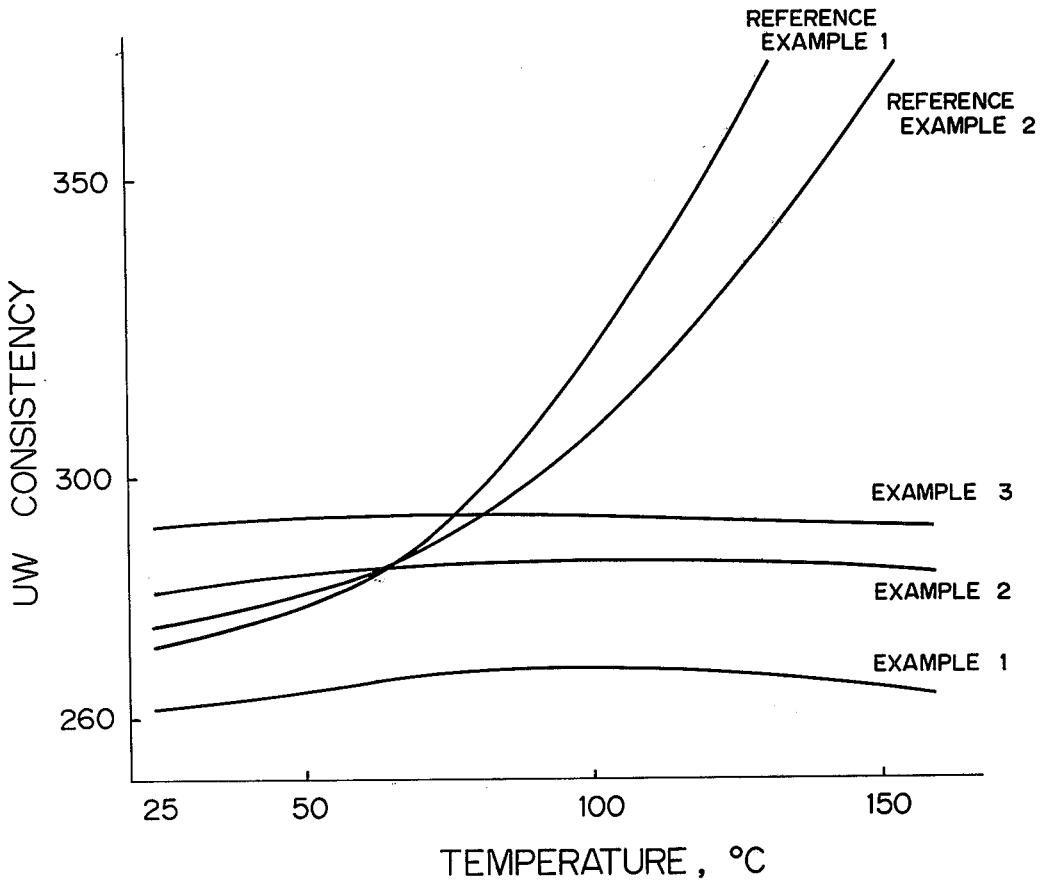
REFERENCE EXAMPLE 1
REFERENCE EXAMPLE 2
EXAMPLE 3
EXAMPLE 2
EXAMPLE 1
350
300
260
UW CONSISTENCY
25
50
100
150
TEMPERATURE, °C

BRAKE GREASE COMPOSITIONS

This invention relates to a novel brake grease composition and more particularly to a novel heat resistant brake grease composition useful for the lubrication and dust sealing of sliding contact surfaces and the like in automobile braking systems.

The sliding contact surfaces in the braking system include those at which wheel cylinder pistons and brake shoes are contacted with each other, those at which anchor pins and brake shoes are contacted with each other and those at which adjusting screws and brake holding pins are contacted with each other. Such contact surfaces are usually in contact with rubber articles and exposed to very high temperatures due to the creation of heat from friction caused by braking. This is particularly the case with disc brakes.

The primary object of this invention is to provide grease compositions capable of high performance under such severe service conditions.

Various kinds of luricants have heretofore been used in the lubrication or dust seal of sliding contact surfaces in the brake system and, among others, many kinds of greases prepared by blending fat oils or mineral oils with various kinds of thickening agents have heretofore been tried to be used. Even these greases are not fully satisfactory, but it is true at the present that users cannot help using them somewhat reluctantly because more satisfactory ones are not available. For example, there are widely used metallic soap greases in which castor oil having excellent anti-rubber swelling property is used as the base oil; however, these greases will soften and leak at high temperatures and will not fully withstand high temperatures brought about at the time of braking because of their unsatisfactory heat resistance, thereby causing their carbonization and sticking which raise troublesome problems. In addition, the castor oil used as the base oil has ethylenic or carbon-to-carbon double bonds and is therefore not stable thereby causing aging after a long period of storage time or the like.

Various studies were made by the present inventors in an attempt to overcome the aforesaid drawbacks and, as a result of their studies, it has been found that greases prepared by blending polyoxypropylene glycol monoether as the base oil with a urea-type thickening agent are those which meet anti-rubber swelling property, water resistance (or water repellency) and other properties required in brake greases and which are remarkably improved in high-temperature stability, heat resistance and storage stability. This invention is based on this finding or discovery.

The grease composition of this invention comprises:

(A) a polyoxypropylene glycol monoether as the lubricating base oil, having a pour point of not higher than −20° C, a flash point of not lower than 200° C and a viscosity of not lower than 8 cSt at 98.9° C and (B) a gelling agent as the thickening agent, consisting of at least one diurea compound represented by the general formula $$R_2NH\overset{O}{\overset{\|}{C}}NHR_1NH\overset{O}{\overset{\|}{C}}NHR_3$$

wherein $R_1$ is a divalent aromatic hydrocarbon radical, and $R_2$ and $R_3$ are each a cyclohexyl group, a cyclohexyl derivative group having 7 – 12 carbon atoms or an alkyl group having 8 – 20 carbon atoms. It is desired that the gelling agent has a cyclohexyl or cyclohexyl derivative group content of at least 20% as calculated from the formula $$\frac{\text{No. of cyclohexyl or cyclohexyl derivative group}}{\text{No. of cyclohexyl or cyclohexyl derivative group} + \text{No. of alkyl group}} \times 100\%.$$

The polyoxypropylene glycol monoethers used as the base oil of the grease compositions of this invention are generally produced by addition polymerizing an alcohol (ROH) or the like with propylene oxide in the presence of an alkaline catalyst and they are represented by the general formula $$RO(CH_2-\overset{CH_3}{\overset{|}{C}}H-O)_n-H$$

wherein R is an alkyl group.

The polyoxypropylene glycol monoethers used herein may be those having a pour point of not higher than −20° C, a flash point of not lower than 200° C and a viscosity of not lower than 8 cSt and, to meet these reqiurements, n in the above formula may vary from 4 to 300 and the molecular weight of the monoethers may vary about 250 to about 20,000 accordingly.

The diurea type tickening agents used in this invention, which are generally available as a reaction product of a monoamine and diisocyanate, are a gelling agent consisting of a diurea compound represented by the formula $$R_2-NH\overset{O}{\overset{\|}{C}}NHR_1-NH\overset{O}{\overset{\|}{C}}NH-R_3$$

wherein $R_1$ is a divalent aromatic hydrocarbon radical having 6 – 15 carbon atoms, and $R_2$ and $R_3$ are each a cyclohexyl group, a cyclohexyl derivative group having 7 – 12 carbon atoms or an alkyl group having 8 – 20 carbon atoms. The gelling agent may preferably have a cyclohexyl or cyclohexyl derivative group content of at least 20% as calculated from the formula $$\frac{\text{No. of cyclohexyl or cyclohexyl derivative group}}{\text{No. of cyclohexyl or cyclohexyl derivative group} + \text{No. of alkyl group}} \times 100\%.$$

The grease compositions of this invention contain the gelling agent as the thickening agent in an amount of 2 – 25% by weight of the grease composition. The aforementioned divalent aromatic hydrocarbon radical having 6 – 15 carbon atoms includes, as a particularly preferable one,

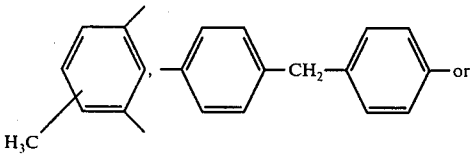

-continued

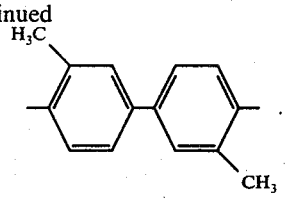

Divalent aromatic hydrocarbons show excellent heat stability, oxidation stability and the like.

The cyclohexyl groups or cyclohexyl derivative groups having 6 – 12 carbon atoms include cyclohexyl, methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl groups; among others, cyclohexyl, methylcyclohexyl and ethylcyclohexyl groups are particularly preferable. The alkyl groups having 8 – 20 carbon atoms used herein are straight-chain or branched-chain ones such as octyl, nonyl, decyl, undecyl, dodecyl, tridecyl, tetradecyl, pentadecyl, hexadecyl, heptadecyl, octadecyl, octadecenyl, nonadecyl and eicodecyl groups, with hexadecyl, heptadecyl, octadecyl, octadecenyl and nonadecyl being particularly preferred. In addition, alkyl groups having more than 20 carbon atoms are also usable for the purpose of this invention; however, the use of starting materials containing such alkyl groups are disadvantageous from the economical point of view.

In this invention, the mol % of terminal groups of the diurea compounds is particularly important. More particularly, a cyclohexyl group or cyclohexyl derivative group and an alkyl group are present respectively at the terminals of the diurea, and the cyclohexyl or cyclohexyl group content is in the range of preferably at least 20%. Diureas having such a content of less than 20% will have a remarkably low dropping point and exhibit an inferior gelling function.

The diurea compounds used in this invention are generally a reaction product of an isocyanate and a primary amine. They are prepared as indicated in the following chemical reaction formulae.

$$R_2-NH_2 + OCN-R_1-NCO + H_2N-R_3 \longrightarrow R_2-NH-\overset{\overset{\displaystyle O}{\|}}{C}-NH-R_1-NH-\overset{\overset{\displaystyle O}{\|}}{C}-NH-R_3 \quad (1)$$

$$R_2-NCO + H_2N-R_1-NH_2 + OCN-R_3 \longrightarrow R_2-NH-\overset{\overset{\displaystyle O}{\|}}{C}-NH-R_1-NH-\overset{\overset{\displaystyle O}{\|}}{C}-NH-R_3 \quad (2)$$

Diurea compounds may be produced in accordance with either of the above chemical reaction formulae. In this invention, a process for the production of the urea compositions in accordance with the chemical reaction formula (1) will be explained.

A cyclohexylamine (or its derivative) alone, or a mixture of a cyclohexylamine(or its derivative) with an alkylamine (the amount of the cyclohexylamine(or its derivative) used being determined such that the number of the cyclohexyl or its derivative group is at least 20% of the total of number of the cyclohexyl or its derivative and number of the alkyl group) is incorporated with a diisocyanate to react them with each other. In this reaction, there may be used a volatile solvent such as benzene, toluene, xylene, hexane, naphtha, diisobutyl ether, carbon tetrachloride and petroleum ether. Lubricating base oils may also be used as a suitable solvent. The reaction temperature may be in the range of 100° – 200° C. At the time of the reaction in this manner, thorough mixing is necessary to produce homogeneous diurea greases. The diurea compounds produced using the volatile solvent as mentioned above are freed of the solvent and incorporated with a suitable amount of the lubricating oil type base oil to obtain a grease composition. Those produced using the lubricating base oil as the solvent may be used as a grease composition as they are. The grease compositions so obtained may be incorporated with additives useful for further improving the compositions in performance. The additives include, for example, other gelling agents, extreme pressure agents, antioxidants, oiliness improves, anti-rust agents, anticorrosive agents and viscosity index improves. The diurea compounds so produced may be used in amounts of 2 – 25% by weight of the grease composition in the preparation of the grease composition. The diurea compounds used in amounts of less than 2 wt.% in the preparation of a grease composition will not be effective as a gelling agent for the resulting composition, while those used in amounts of more than 25% by weight of the grease composition will not further be effective.

Therefore, this is disadvantageous economically. The diurea compounds used in unduly large amounts in the preparation of a grease composition will make the resulting composition too hard as grease whereby the composition does not exhibit satisfactory lubricating performance.

The grease compositions of this invention, which are prepared by compounding a polyoxypropylene glycol monoether with a diurea compound as the thickening agent, may be incorporated with various additives for improving the compositions in performance as grease as required.

Typical of these additives are phenol- and amine-type antioxidants, anti-wear agents, tackiness improvers, anti-rust agents and metal deactivators; in some cases, they may include solid lubricats such as molybdenum disulfide, graphite, zinc oxide and fluorine resins, for example, polytetrafluoroethylenes. These additives should usually be contained in the grease compositions in amounts of not more than 20% by weight of the grease composition.

This invention will be better understood by the following Examples.

EXAMPLE 1

Four hundred and ten (410) grams of 810g of a polyoxypropylene glycol monoether having a pour point of −40° C, a flash point of 220° C, a viscosity of 10.6 cSt at 98.9° C and an average molecular weight of 1100, were incorporated with 22.7g of diphenylmethane-4, 4'-diisocyanate to form a mixture which was then heated to 60° – 70° C to be melted uniformly. The mixture so melted was incorporated with a mixture in molten state of 14.6g of octadecylamine, 12.7g of cyclohexylamine and the remaining 400g of the polyoxypropylene glycol monoether and then agitated vigorously thereby producing a gel-like material immediately. The gel-like material so produced was maintained at 120° C under continuous agitation for 30 minutes, after which it was incorporated with 10g of an amine type antioxidant, 30g of a tackiness improver (polybutene) and 100g of ZnO and the resulting mixture was well agitated and treated on a 3-roll mill thereby to obtain a desired grease composition.

| | |
|---|---|
| UW | 262 |
| 60W | 264 |
| 100,000W | 282 |
| Dropping point | 270° C or higher |

EXAMPLE 2

A polyoxypropylene glycol monoether (7570g) having a pour point of −40°, a flash point 255° C, a viscosity of 11 cSt at 98.9° C and an average molecular weight of 1150 was incorporated with 725g of diphenylmethane-4,4'-diisocyanate to form a mixture which was heated to 60° - 70° C to be melted. The mixture so melted was then incorporated with 575g of cyclohexylamine to produce a gel-like material immediately. The gel-like material so produced was heated to 100° C under vigorous agitation, after which it was incorporated with 130g of an antioxidant, 500g of a tackiness improver and 500g of polytetrafluoroethylene powder to form a mixture which was agitated thoroughly and then milled thereby obtaining a desired grease composition.

| | |
|---|---|
| UW | 281 |
| 60W | 282 |
| 100,000 | 299 |
| Dropping point | 270° C or higher |

EXAMPLE 3

A polyoxypropylene glycol monoether (1420g) having a pour point of −33° C, a flash point of 222° C, a viscosity of 21 cSt at 98.9° C and an average molecular weight of 2300, was incorporated with 120g of 2,4 - 2,6 — tolylenediisocyanate to form a mixture which was agitated to be made homogeneous. The homogeneous mixture was incorporated with 139g of methylcycloheylamine to produce a gel-like material immediately. The gel-like material so produced was maintained at 120° C under vigorous agitation for 30 minutes, after which it was incorporated with 20g of an antioxidant, agitated thoroughly and milled on a three-roll mill thereby obtaining a desired grease composition.

| | |
|---|---|
| UW | 292 |
| 60W | 293 |
| 100,000W | 317 |
| Dropping point | 270° C or higher |

The properties of the grease compositions obtained in Examples 1 - 3 are shown in the following Table. In addition, the Table also shows the properties of a commercially available brake grease (Reference example 1) prepared by blending a grease consisting of castor oil and lithium stearate, with ZnO and an antioxidant, and those of a Li type grease (Reference example 2) in which a mineral oil type base oil is used.

Table

| Properties | Example 1 | Example 2 | Example 3 | Reference 1 | Reference 2 |
|---|---|---|---|---|---|
| Dropping point ° C | 270 or higher | 270 or higher | 270 or higher | 192 | 198 |
| Consistency | | | | | |
| UW (Unworked penetration) | 262 | 281 | 292 | 272 | 275 |
| 60W(Penetration after 60 strokes) | 264 | 282 | 293 | 283 | 276 |
| 100,000W(Penetration after 100,000 strokes) | 282 | 299 | 317 | 352 | 348 |
| Oxidation stability(150° C,100hr)Kg/cm$^2$ | 2.5 | 2.2 | 2.4 | 6.0 | 6.2 |
| Film test (150° C, 100hr), Appearance | Substantially no change | Substantially no change | Substantially no change | Changed in color to brown, run down | Changed in color to brown, run down |
| Oil bleeding (150° C, 100hr)% | 2.2 | 2.9 | 3.1 | 29.6 | 15.2 |
| Water wash resistance | | | | | |
| 38° C | 1.0 | 0.8 | 1.2 | 3.4 | 2.4 |
| 79° C | 3.2 | 4.0 | 3.9 | 17.0 | 9.6 |
| Rubber swelling test (70° C, 70hr) | | | | | |
| Chloroprene | | | | | |
| Change in volume% | −8.8 | −7.2 | −8.4 | −9.2 | +11.3 |
| Change in weight% | −6.5 | −5.6 | −6.4 | −6.7 | + 9.5 |
| SBR | | | | | |
| Change in volume% | +4.0 | +4.2 | +3.9 | +1.5 | + 5.4 |
| Change in weight% | +3.3 | +3.0 | +2.8 | −0.8 | + 4.8 |

Note)
The properties in the above Table were measured by the following test methods, respectively.
Dropping point : JIS(Japanese Industrial Standard) K 2561
Consistency (expressed by penetration) : JIS K 2560

Oxidation stability: JIS K 2569

Film test: Grease to be tested is coated on an iron plate so that the coated grease layer has a diameter of 45 mm and a thickness of 3mm. The iron plate so coated is placed in a thermostatic chamber at 150° C for 100 hy and then the appearance of the grease layer is observed.

Oil bleeding: JIS K 2570

Water wash resistance: JIS K 2572

Rubber swelling test: Rubber test samples are wholly immersed in grease at 70° C for 70hr, after which they are measured for change in volume and change in weight, "+" meaning "increase" and "−" meaning "decrease".

The graphs in the accompanying drawing indicate the relations between the UW penetration of brake greases of Examples 1 - 3 and Reference example 1 - 2, and temperatures to which the brake greases are exposed. These relations are obtained by maintaining the brake greases in a thermostatic chamber at predetermined temperatures for one hour and thereafter measuring the greases at said temperatures for their consistency (in penetration).

The above Table shows that the grease compositions of this invention are remarkably excellent in heat resistance and water resistance as compared with the conventional ones.

From the accompanying drawing it is seen that the conventional brake greases decrease in consistency or soften at high temperatures while the brake greases of this invention hardly change in consistency even at high temperatures, this indicating that as compared with the conventional brake greases, the grease compositions of this invention are satisfactory ones which will substantially not run out or leak out of lubricating surfaces to which they are applied.

The antioxidant used in the Examples 1 – 3 was phenyl-α-naphthylamine and the tackiness improver was polybutene having an average molecular weight of 2350 in Example 1 and polyisobutylene having an average molecular weight of 10,000 in Example 2.

The antioxidants used in this invention include 2, 6-di-t.-butyl-p-cresol, 4, 4'-methylene-bis(2,6-di-t.-butylphenol), phenyl-α-naphthylamine, diphenylamines, phenylenediamines or derivatives thereof and oleylamideamine.

What is claimed is:

1. A brake grease composition comprising:

(A) a polyoxypropylene glycol monoether as the lubricating base oil, having a pour point of not higher than −20° C., a flash point not lower than 200° C. and a viscosity of not lower than 8 cSt at 98.9° C. and (B) a gelling agent as the thickening agent, consisting of at least one diurea compound represented by the general formula $$R_2NH\overset{\overset{\displaystyle O}{\|}}{C}NHR_1NH\overset{\overset{\displaystyle O}{\|}}{C}NHR_3$$

wherein $R_1$ is a divalent aromatic hydrocarbon radical, and $R_2$ and $R_3$ are each of cyclohexyl, a cyclohexyl derivative group having 7–12 carbon atoms or an alkyl group having 8–20 carbon atoms; and wherein the gelling agent has a cyclohexyl or cyclohexyl derivative group content of at least 20% as calculated from the formula $$\frac{\text{No. of cyclohexyl or cyclohexyl derivative group}}{\text{No. of cyclohexyl or cyclohexyl derivative group + No. of alkyl group}} \times 100\%.$$

2. A brake grease composition according to claim 1, wherein the gelling agent is contained in an amount of 2 – 25% by weight of the grease composition.

3. A brake grease composition according to claim 1, further comprising at least one additive selected from the group consisting of an antioxidant, anti-wear agent, tackiness improver, anti-rust agent and metal deactivator.

4. A brake grease composition according to claim 1, further comprising at least one solid lubricant selected from the group consisting of molybdenum disulfide, graphite, zinc oxide and polytetrafluoroethylenes.

5. A brake grease composition according to claim 2, further comprising at least one solid lubricant selected from the group consisting of molybdenum disulfide, graphite, zinc oxide and polytetrafluoroethylenes.

6. A brake grease composition according to claim 1, wherein the divalent aromatic hydrocarbon radical is a member selected from the group consisting of

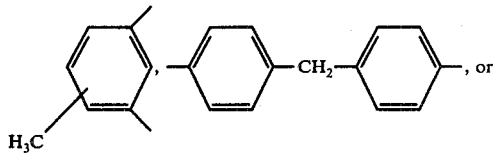

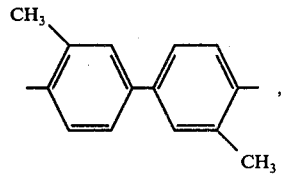

the cyclohexyl derivative group is a member selected from the group consisting of methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl groups, and the alkyl group is a member selected from the group consisting of octyl, nonyl, decyl, undecyl, dodecyl, tridecyl, tetradecyl, pentadecyl, hexadecyl, heptadecyl, octadecyl, octadecenyl, nonadecyl and eicodecyl groups.

7. A brake grease composition according to claim 5, wherein the divalent aromatic hydrocarbon radical is a member selected from the group consisting of

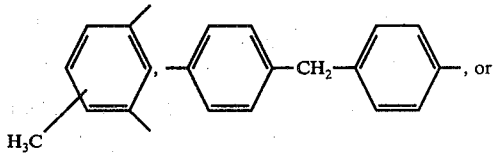

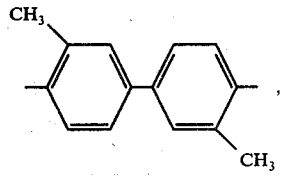

the cyclohexyl derivative group is a member selected from the group consisting of methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amyl-methylcyclohexyl and hexylcyclohexyl groups, and the alkyl group is a member selected from the group consisting of octyl, nonyl, decyl, undecyl, dodecyl, tridecyl, tetradecyl, pentadecyl, hexadecyl, heptadecyl, octadecyl, octadecenyl, nonadecyl and eicodecyl groups.

* * * * *